United States Patent [19]

Peel et al.

[11] Patent Number: 4,691,922

[45] Date of Patent: Sep. 8, 1987

[54] GOLF PRACTICE DEVICE

[76] Inventors: Robert M. Peel, 2328 Newton St., Akron, Ohio 44305; John T. Darner, 150 Davenport Ave., Arkon, Ohio 44312

[21] Appl. No.: 837,794

[22] Filed: Mar. 10, 1986

[51] Int. Cl.[4] ..... A63B 69/36

[52] U.S. Cl. ..... 273/177 B; 273/34 R

[58] Field of Search ..... 273/177 R, 177 A, 177 B, 273/178 R, 178 A, 180, 181 B, 34 R, 34 A, 34 B

[56] References Cited

U.S. PATENT DOCUMENTS

| | | | |
|---|---|---|---|
| 3,086,779 | 4/1963 | Taylor | 273/177 R |
| 3,341,206 | 9/1967 | Ganger | 273/177 B |
| 3,458,202 | 7/1969 | McNamara | 273/177 R |
| 4,407,505 | 10/1983 | Kendziorski | 273/177 R |

FOREIGN PATENT DOCUMENTS

| | | | |
|---|---|---|---|
| 184409 | 8/1922 | United Kingdom | 273/177 A |
| 504628 | 4/1939 | United Kingdom | 273/177 R |

*Primary Examiner*—George J. Marlo
*Attorney, Agent, or Firm*—Oldham, Oldham & Weber Co.

[57] ABSTRACT

Golf practice device, especially for putting and approach shot practice. The device comprises an elongated shaft having a tapered end for insertion into the ground, a stop adjacent to the pointed end for limiting the depth of insertion, and a target spaced a short distance from the pointed end for indicating the accuracy of the golfer's stroke. The target is preferably a bendable disk having a diameter about the same as the diameter of a standard golf hole, i.e. about 4.25 inches. The distance from the stop to the target may range from about one-half the diameter of a golf ball (which is 1.68 inches) to about the diameter of a golf ball. The golfer inserts the pointed end of the shaft into the ground so that the shaft is substantially upright. He or she then putts or chips the ball toward the shaft. If the ball comes to rest either against or under the marker, the golfer has "holed out".

12 Claims, 7 Drawing Figures

GOLF PRACTICE DEVICE

TECHNICAL FIELD

This invention relates to a golf practice device and more particularly to a portable practice device which enables a golfer to practice putts and chip shots even when no practice hole is available.

BACKGROUND ART

Most golf courses provide practice greens on which a golfer may practice putting. Golfers are most likely to use the practice greens before playing a round of golf. When a golf course is crowded, a number of golfers may be waiting to tee off the first tee. The practice greens become crowded at such times. Often at such times the number of golfers desiring to use the practice greens far exceeds the number of holes. The situation calls for a device which will enable the golfer to practice putting, and short iron shots when possible, even when no hole is available.

Golf practice devices which enable the golfer to practice putting and approach shots even when no hole is available are known. However, such devices have their limitations, and none has achieved widespread popularity.

U.S. Pat. No. 3,086,779 to Taylor discloses a practice device for putts and approach shots which includes a disk or spider which may be placed against the grass or turf and a vertical shaft which can be inserted into the ground through a central opening in the disk or spider. The disk or spider depresses the grass under it so as to form a simulated golf cup. When a golf ball rolls into the simulated cup, the upstanding grass and turf tend to hold th ball in the cup. Of course, if the ball is hit strongly, it may roll out.

The device of U.S. Pat. No. 3,086,779 has certain shortcomings. First, the device is designed for use on fairly high grass rather than on the close cropped grass which characterizes a well maintained putting surface. A ball putted on high grass travels slowly and for a shorter distance than it would on a putting green, so that the golfer would not have a true indication as to how accurate the direction and distance of his putts really are. If the device were used on a closely cropped putting green, the wire at the circumference would stand up above the grass and would either stop or deflect a ball which hits it. The golfer in many cases would not know if the ball would have dropped into a real hole or if it would have grazed the hole and kept going. As golfers know, a ball which is hit too strongly may fail to drop into the hole even though the direction is quite accurate. The device does not accurately indicate which balls would drop into a real hole and which would merely graze the hole without dropping.

U.S. Pat. No. 4,407,505 to Kenziorski shows a portable, collapsible golf practice device intended especially for practice driving or "shagging" golf balls. The device includes a weighted cylindrical base at ground level. The device can be used for putting practice; the base serves as the target. The base should have a diameter of about 1.4 inches for putting practice, according to the patentee. Also according to patentee, if a ball putted toward a base of this diameter comes into contact with the base the golfer can assume that it would have sunk in regulation play. Actually, it appears that this may not always be the case. A hard hit ball, especially, might strike the base and yet merely graze the cup under actual play conditions.

Although golf putting practice devices are known, none accurately indicates which golf balls would drop into a real hole and which would merely graze the cup.

DISCLOSURE OF INVENTION

An object of this invention is to provide a device which will enable the golfer to practice putting and approach shots on any lawn or grassy area, without the necessity for a golf hole.

A related object of this invention is to provide a golf practice device which indicates more accurately than presently known devices of the same general type whether or not the golfer would have "holed out" under actual play conditions.

Further objects and advantages will be apparent from the description which follows and the accompanying drawings.

The present invention provides a novel golf practice device which comprises an elongated shaft, means at one end of the shaft for supporting the shaft in a substantially upright position, and a target mounted on the shaft near said one end and extending outwardly from the shaft, the diameter of the target being about equal to the diameter of a golf hole.

BRIEF DESCRIPTION OF DRAWINGS

Figure 1:
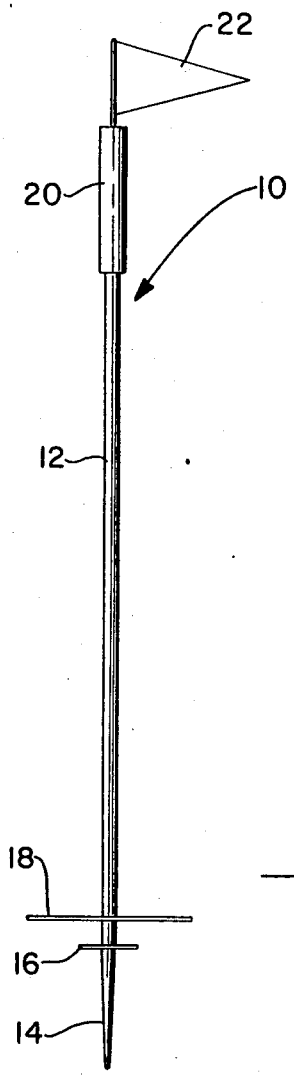

IN THE DRAWINGS:

FIG. 1 is a front elevational view of the golf practice device according to a preferred embodiment of this invention.

Figure 2:
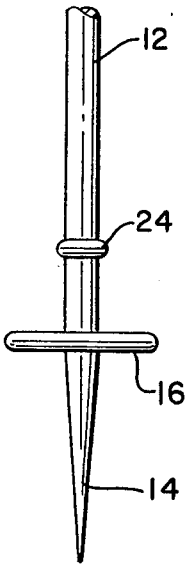

FIG. 2 is a front elevational view of the lower portion of the device shown in FIG. 1 but on a larger scale.

Figure 3:
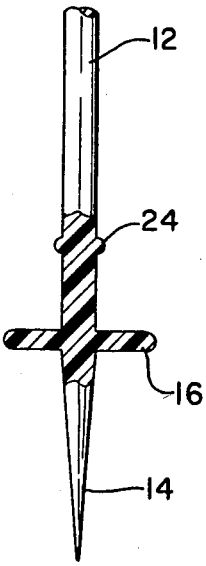

FIG. 3 is a vertical sectional view, with parts shown in elevation of the lower portion of the preferred device of this invention.

Figure 4:
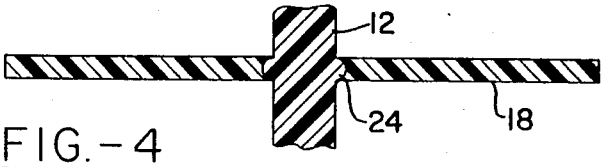

FIG. 4 is a vertical sectional view, of the target disk and a small portion of the shaft in the preferred device.

Figure 5:
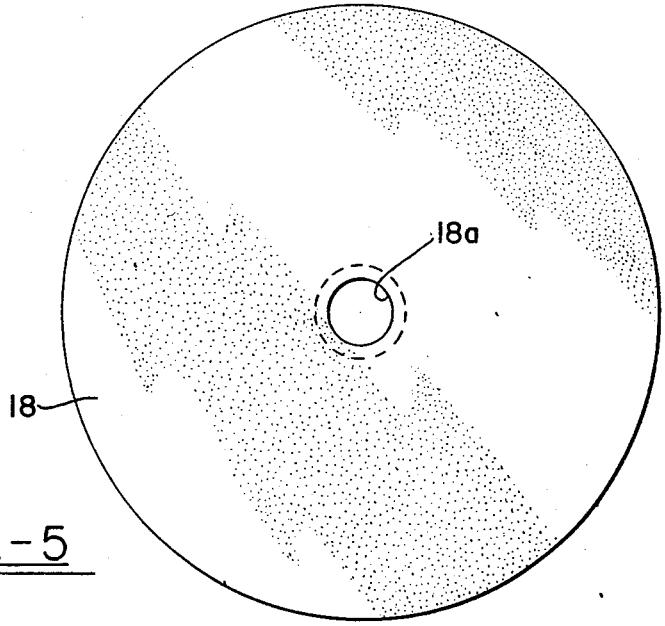

FIG. 5 is a top view of the target disk.

Figure 6:
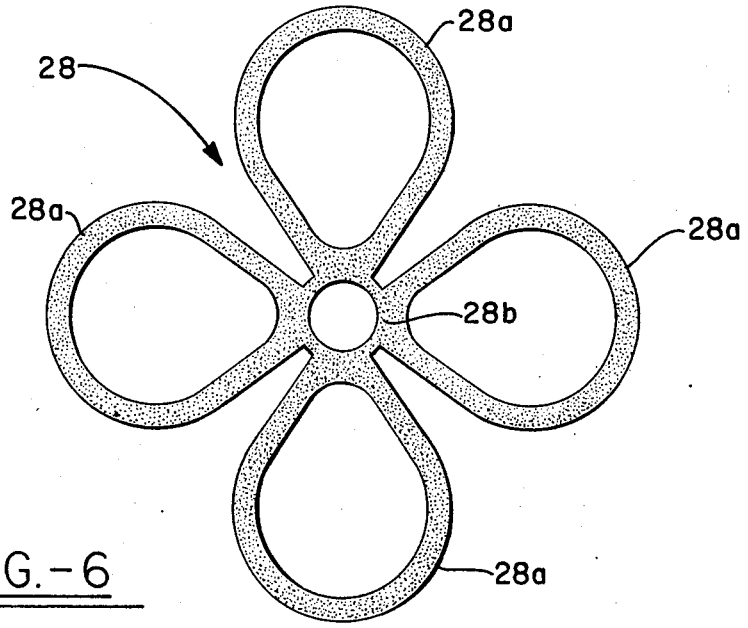

FIG. 6 is a top view of an alternative target.

Figure 7:
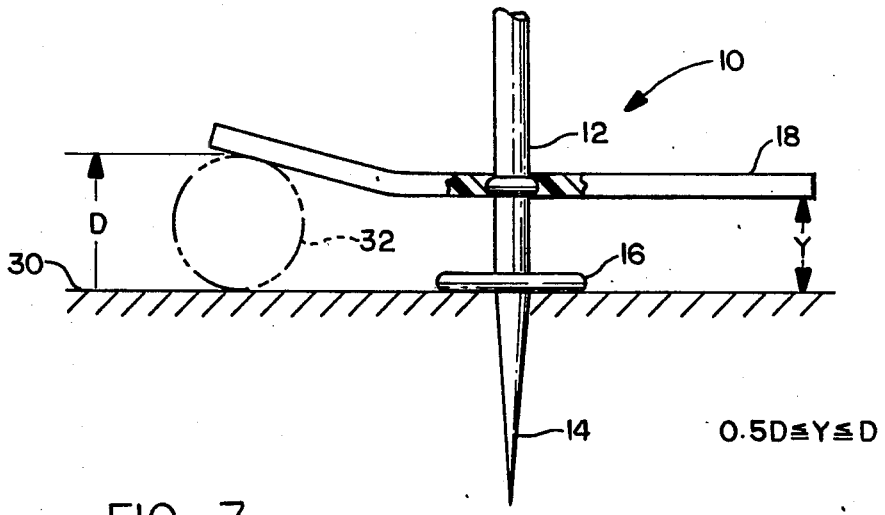

FIG. 7 is a front elevational view of a golf practice device ot this invention, inserted into the ground, with a golf ball struck toward it so that the golf ball wedges under the target disk.

BEST MODE FOR CARRYING OUT INVENTION

This invention will be further described in detail with respect to the preferred embodiment thereof, which is shown in FIGS. 1 to 5.

Referring now to FIG. 1, the preferred golf practice device 10 of this invention comprises an elongated vertical shaft 12 which has a tapered tip 14 which enables the device 10 to be inserted into the ground, and a thin horizontal positioning disk or limit stop 16 which limits the extent of insertion. The bottom of limit stop 16 is against the ground when the device 10 is properly inserted. Also, when the device 10 is properly inserted into the ground, the shaft 12 is substantially vertical. Words connoting position or direction (e.g., "horizontal", "vertical", "above", etc.) in this description refer to the position or direction when the device 10 is installed in the ground.

A thin horizontal disk 18 which serves as a target is mounted on shaft 12 a short distance above limit stop 16. Disk 18 has a central opening 18a (See FIG. 5) so that it will be concentrically mounted on shaft 12. The plane of target disk 18 is at right angles to the axis of shaft 12.

The diameter of disk 18 is about 4.25 inches, which is the diameter of a regulation golf hole in the United States. The diameter of target disk 18 is always about the same as the diameter of a regulation golf hole, so that the disk will fulfill its purpose as a target. Therefore, in any countries where the regulation golf hole diameter is different from 4.25 inches, the diameter of disk 18 will vary accordingly.

The distance between target disk 18 and limit stop 16 (i.e. the distance of disk 18 above the ground) is in the range of from about one-half the diameter of a regulation golf ball to about the diameter of a regulation golf ball. The height of disk 18 above the ground is preferably slightly more than one-half of ball diameter and slightly less than ball diameter, so that an accurately hit ball will deflect the disk upwardly and will become wedged under the disk. A disk height of about two-thirds of ball diameter is especially preferred. A regulation golf ball in the United States has a diameter of 1.68 inches so that the distance between target disk 18 and limit stop 16 is from about 0.84 inch to 1.68 inches with a height of about 1.12 inches being especially preferred. If the height of target 18 is higher than the diameter of a golf ball, some balls which would drop into a regulation hole will merely pass under target 18 and stop beyond device 10. (Balls hit strongly, but not too strongly to drop into a regulation hole, would behave in this manner). Thus, target 18 furnishes a less accurate indication as to whether a ball would drop under actual play conditions if its height exceeds the diameter of a golf ball.

A handle 20 overlies the top end of shaft 12. Handle 20 is both decorative and functional. Handle 20 enables the golfer to pull the device 10 out of the ground easily. The design of handle 20 may vary widely as desired for decorative purposes, and the design of the handle does not form a part of this invention. For purposes of illustration, handle 20 is shown as a cylinder of somewhat larger diameter than that of shaft 12.

A flag 22 may be placed atop device 10 above handle 20 if desired. Flag 22 is optional. The primary purpose of flag 22 is decorative, although the flag is useful in helping the golfer to spot device 10 when he or she is practicing chip shots or long putts.

FIGS. 2 and 3 show the lower portion of device 10 on an enlarged scale, with target disk 18 omitted. As seen in FIGS. 2 and 3, the lower end of tip 14 is rounded for safety reasons. Also as seen in FIGS. 2 and 3, and especially as shown in FIG. 4, shaft 12 has a collar 24. Target disk 18 is secured to collar 24 by a snap action fit. Collar 24 and disk 18 have the same thickness. Referring to FIG. 4, the outer edge of collar 24 is convex, preferably of semicircular configuration. Disk 18 is a ring having a central opening 18*a* of the same diameter as that of collar 24, as best seen in FIG. 5. The edge of this central opening is concave and of the same curvature as that of the outer edge of collar 24, giving the desired snap action fit.

Shaft 12 is preferably solid and made of molded plastic, preferably polyvinyl chloride (PVC). Limit stop 16 and collar 24 are molded integrally with shaft 12.

The entire device 10, including shaft 12, limit stop 16, target disk 18 and handle 20 (but not including the optional flag 22) can be molded in one piece if desired. No separate collar 24 is required in this case.

Alternatively, shaft 12 may be metallic, e.g. of cast aluminum or tubular stainless steel. In the case of tubular steel, limit stop 16 and collar 24 are separate pieces, either plastic or metallic, which are affixed to shaft 12 by conventional means, e.g. by joining with a suitable adhesive.

Shaft 12 is preferably about the same length as the longest golf club, i.e. the driver. The upper end of the shaft will extend out the open end of a golf bag. If shaft 12 is longer than the driver, it should be made in two or more pieces and be capable of folding or telescoping. The latter requires tubular plastic and/or metal construction. The shaft may be of any desired diameter, e.g., about $\frac{1}{4}$ to $\frac{3}{8}$ inch, the latter being preferred.

Although other means for inserting one end of shaft 12 into the ground may be used, the tapered tip 14 shown is by far the simplest and most effective.

The diameter and thickness of limit stop 16 are not critical. The diameter of limit stop 16 is normally less than that of taraget disk 18. The thickness is sufficient so that limit stop 16 is rigid.

Disk 18 is preferably made of a molded plastic; polyvinyl chloride is preferred. A metallic disk, e.g. aluminum or steel, may be used if desired. Disk 18 should be flexible, although it may be fairly stiff (i.e., it may offer a fairly high resistance to flexing). This enables disk 18 to flex and wedge the ball when struck by an accurately hit golf ball. Flexibility also permits the golfer to bend the disk to put it into a golf bag. Disk 18 also should have memory; that is, it should return to its original shape when flexed or bent.

The thickness of disk 18 is such that it will have the desired flexibility. The preferred thickness depends on the stiffness of the material, and so will vary from material to material. A flexible vinyl (e.g. PVC) disk will ordinarily have a thickness of about 0.01 to about 0.1 inch. A thickness of about 0.05 inch being especially preferred.

Collar 24 has the same thickness as target disk 18. The diameter of collar 24 is only slightly larger than the diameter of shaft 12.

Target disk 18 does not have to be a thin flat circular disk as shown in FIGS. 1–5. An alternative shape is shown in FIG. 6. In FIG. 6, target disk 28 has four petals 28*a* and a ring 28*b* which fits around collar 24. The entire disk 28 lies in one plane. The span or diameter of target disk 28, i.e. the distance from the tip of one petal 28*a* to the tip of the opposite petal, is about equal to the diameter of a regulation golf hole, i.e. 4.25 inches.

Still other target disk structures are possible. The target does not have to be planar, it can be conical or umbrella shaped, as long as the diameter or span is about equal to the diameter of a golf hole and the height above the ground (i.e. above positioning disk 16) is from about one-half the diameter of a golf ball to about the diameter of a golf ball.

The practice device 10 is particularly useful for putting practice, as shown in FIG. 7. The golfer inserts the device 10 into the ground 30, preferably a practice putting green, at any desired location. The height Y of the target 18 above the ground is at least $\frac{1}{2}$ the diameter D of a golf ball and is not greater than the height D of a golf ball. Stated mathmatically, $0.5D \leqq Y \leqq D$. He then putts a ball toward target 18. A ball 32 that is hit with the correct direction and distance will strike the target and normally will be wedged under the target and come to rest thereunder. Device 10 enables the golfer to practice putting even when the practice green is crowded and too few holes are available.

Device 10 can also be used for approach or chip shot practice. Less crowded conditions are required for chip shot practice than for putting practice, as any golfer will appreciate. On the other hand, a wider range of ground surfaces can be used for chipping than for putting. High grass or even bare ground can be used for chip shot practice, unless the golfer wishes to putt and "hole out" following the chip shots. (High grass and bare ground can be used for putting, but the ball will behave differently from the way it behaves on a putting green).

The device of the present invention furnishes a more accurate indicator than presently known devices as to which balls would sink in regulation play and which balls would merely graze the hole. When the target 18 is at a height of more than one-half the diameter of a golf ball but less than the diameter of a golf ball, the golfer can assume that any ball that strikes target 18 and comes to rest thereunder would have dropped into a regulation hole. Similarly, any ball which strikes the target but is merely deflected or keeps on going would have grazed the hole without dropping in actual play.

While in accordance with the patent statutes, a preferred embodiment and best mode has been presented, the scope of the invention is not limited thereto, but rather is measured by the scope of the attached claims.

What is claimed is:

1. A golf practice device comprising:

(a) an elongated shaft having one end adapted to be inserted into the ground for supporting said shaft in a substantially upright postion with its other end uppermost; and (b) a thin, relatively stiff, flexible, bendable, generally planar target having memory, said target being mounted on said shaft near said one end thereof and extending outwardly at a right angle therefrom, the diameter of said target being about equal to the diameter of a golf hole, and means for connecting said target to said shaft so that said target will bend in response to a golf ball rolling thereunder and contacting same when said target is held by said shaft at a predetermined distance above a putting surface.

2. A golf practice device according to claim 1 in which said target is essentially planar.

3. A golf practice device according to claim 1 in which said target is a disk.

4. A golf practice device according to claim 3 in which said disk is concentrically mounted on said shaft at a right angle thereto.

5. A golf practice device according to claim 1 in which the target is mounted on said shaft so that the distance from the peripheral portions of the target to the golfing surface may be in the range of from about one-half the diameter of a golf ball to about the diameter of a golf ball.

6. A golf practice device according to claim 1 including a collar on said shaft for receiving said target.

7. A golf practice device according to claim 6 in which said target is a disk.

8. A golf practice device according to claim 1 in which said one end of said shaft into the ground comprises a tapered tip.

9. A golf practice device according to claim 1 including a stop for limiting the length of said shaft which may be inserted into the ground.

10. A golf practice device according to claim 9 in which said target is essentially planar and the distance between said target and said stop is in the range of from about one-half the diameter of a golf ball to about the diameter of a golf ball.

11. A golf practice device according to claim 1 in which said target is plastic.

12. A golf practice device according to claim 1 in which said target is a thin flat flexible plastic disk having memory.

* * * * *